US007017747B2

(12) United States Patent
Kiger et al.

(10) Patent No.: US 7,017,747 B2
(45) Date of Patent: Mar. 28, 2006

(54) PROTECTIVE INFLATABLE SURFBOARD COVERING DEVICE

(76) Inventors: Michael W. Kiger, 2500 Via Cabrillo Marina, Suite 306, Sand Pedro, CA (US) 90731; Joseph Carcamo, 1150 Upland Ave., San Pedro, CA (US) 90732

( * ) Notice: Subject to any disclaimer, the term of this patent is extended or adjusted under 35 U.S.C. 154(b) by 231 days.

(21) Appl. No.: 10/630,246

(22) Filed: Jul. 30, 2003

(65) Prior Publication Data

US 2005/0023177 A1 Feb. 3, 2005

(51) Int. Cl.
*B65D 81/02* (2006.01)

(52) U.S. Cl. ..... 206/522; 206/315.1; 383/3

(58) Field of Classification Search ..... 206/315.1, 206/522; 150/154; 441/74; 383/3
See application file for complete search history.

(56) References Cited

U.S. PATENT DOCUMENTS

| | | | | |
|---|---|---|---|---|
| 3,339,607 | A | 9/1967 | Howard | |
| 3,949,879 | A * | 4/1976 | Peterson et al. | 206/522 |
| 4,719,952 | A | 1/1988 | Geronimo | |
| 4,793,535 | A | 12/1988 | Johnson | |
| 5,033,497 | A | 7/1991 | Hernandez | |
| 5,094,344 | A | 3/1992 | Savage | |
| 5,147,235 | A | 9/1992 | Bamburak et al. | |
| 5,193,677 | A | 3/1993 | Moreno | |
| 5,217,131 | A * | 6/1993 | Andrews | 206/522 |
| D337,432 | S | 7/1993 | Caffiero | |
| 6,003,745 | A | 12/1999 | Mechanic | |
| 6,230,951 | B1 | 5/2001 | Anderson | |
| 6,247,985 | B1 | 6/2001 | Block et al. | |
| 6,334,537 | B1 * | 1/2002 | Tepper | 206/522 |
| 6,394,865 | B1 | 5/2002 | Arzadon | |

FOREIGN PATENT DOCUMENTS

| | | | |
|---|---|---|---|
| JP | 614471 | * | 5/1994 |
| WO | WO 93/09998 | * | 5/1993 |

* cited by examiner

*Primary Examiner*—Bryon P. Gehman
(74) *Attorney, Agent, or Firm*—Fulwider Patton LLP

(57) ABSTRACT

A protective surfboard covering device for covering and protecting various selected surfaces of a surfboard including a cover that defines a plurality of inflatable cushions that may include a top surface cushion, a bottom surface cushion and a pair of laterally spaced apart sidewall cushions, the cushions defining therebetween a surfboard compartment and cooperating to form a mouth through which the surfboard is inserted into the surfboard compartment.

6 Claims, 2 Drawing Sheets

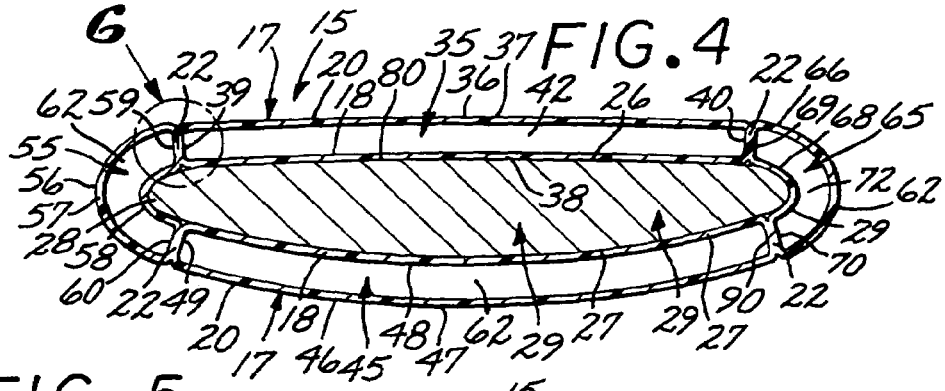
FIG. 4
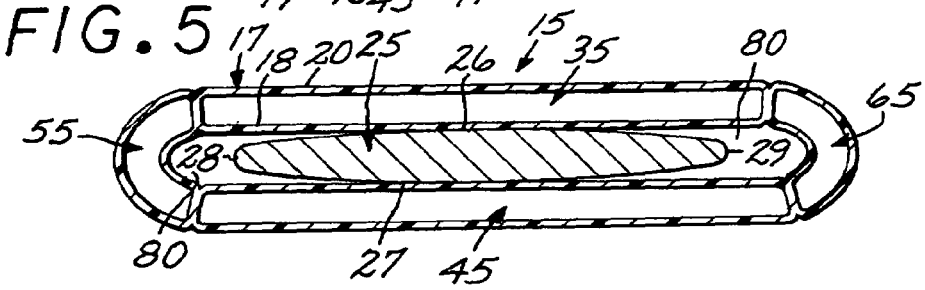
FIG. 5
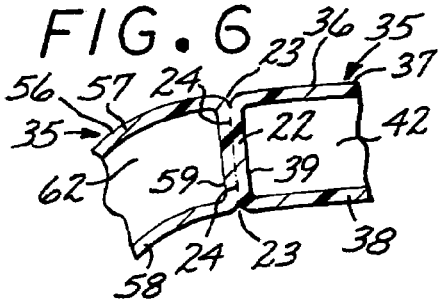
FIG. 6
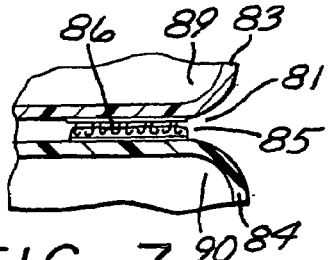
FIG. 7
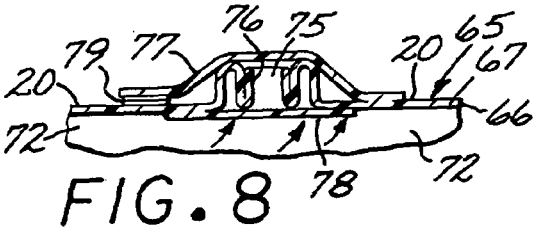
FIG. 8
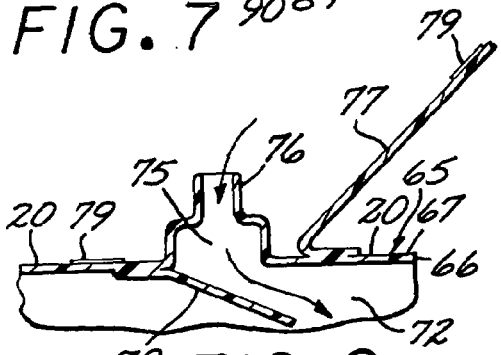
FIG. 9
FIG. 10
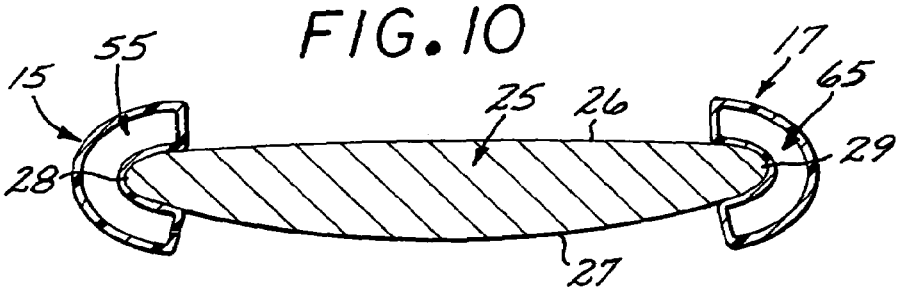

PROTECTIVE INFLATABLE SURFBOARD COVERING DEVICE

BACKGROUND OF THE INVENTION

1. Field of the Invention

The present invention relates to devices for protecting surfboards from damage during transit and storage, and more particularly, to surfboard covers for protecting surfaces such as are found on the top, bottom and side rail sections of a surfboard.

2. Description of Related Art

For many years, surfing has been a well established recreational and sporting activity, and with the progression and increased popularity of the surfing sport, surfers have searched for better designed and constructed surfboards. As the surfing art has progressed, modern technology has produced smaller surfboards that offer greater maneuverability and performance capabilities. Traditional wood or plastic board construction has thus been supplanted by surfboards constructed of lighter and more durable composites, such as, for example, polyurethane or fiberglass.

However, the benefits derived from these lighter and more maneuverable surfboards can be quickly defeated when the surfaces of the board are dented, scratched or otherwise damaged. This is due, at least in part, to the fact that such damage can cause unwanted drag on the board in the water, which will degrade its maneuverability, balance and overall performance. Such damage will typically occur during the transportation of a surfer's board from a home or storage location to a surfing site. During such transport, when the board must be loaded into a vehicle storage compartment and carried therefrom to the water, the surfboard may be subjected to a myriad of impacts or scraped against any number of variously contoured surfaces. Therefore, it is advisable for a surfer to protect his or her surfboard during its transportation to a chosen surfing location. Also, it is especially beneficial to protect specific surfboard surfaces critical to the maneuverability and control of the board such as its side walls (known as "rails" in surfing parlance), its dorsal or top surface on which the surfer stands, and its ventral or bottom surface, which is in contact with the water.

To provide this protection, numerous surfboard covers and carrying cases have been proposed. Some early prior art devices embodied hardened cases for encircling the board similar to guitar cases, but such devices are heavy and awkward during transport, and cannot be collapsed into a smaller and less bulky form for storage when not in use. Other prior art devices have proposed a soft case constructed of fabric or a similar light material, but such a construction, while effective for withstanding minor impacts and scrapes, offers insufficient protection from typical impacts and scraping that must be absorbed during transport or when the surfer accidentally drops the board.

To address this need, various light weight surfboard protectors have been proposed. For example, U.S. Pat. No. 4,719,952 to Geronimo discloses shock absorbing covers, made of a neoprene or synthetic rubber foam sheet material, for individually covering and protecting the forward tip, the rear portion and the side rails of a typical board. However, devices such as this do not provide sufficient protection to the entirety of the top and bottom surfaces of a surfboard, and are unwieldy and awkward to store when not being used to protect it.

Other prior art devices have taught inflatable mats or tubes to protect various surfboard surfaces. For example, U.S. Pat. No. 5,193,677 to Moreno proposes a surfboard bag with a pneumatically inflated guard rail for encircling the circumference of the board's side rails. This guard rail comprises a middle tube and two shorter top and bottom tubes configured to collectively fit the edges of the side rails. However, such a device does not provide for the protection of the remaining surfaces of the board, such as the top and bottom surfaces, and the three tube construction of the guard rail may not be sufficient to prevent impact by an object that may penetrate between the tubes to damage the side rails.

U.S. Pat. No. 6,003,745 to Mechanic discloses a dual purpose surfboard bag that serves both as a sleeping cushion and a board surface protector. Top and bottom pads respectively cover the top and bottom surfaces of the surfboard, and removable and inflatable mats inside the pads protectively sandwich the surfboard while providing a sleeping surface for the surfer. While effective for its intended purpose, the inflatable mats of such a device do not afford adequate protection to all surfaces of the board, especially the side rails, and are not configured to be capable of communication with one another. Further, Mechanic teaches that inflatable mats are to be inserted and fastened into the pads, and that the pads and the mats cooperate to thereafter protect the top and bottom surfaces of the surfboard.

Therefore, a need exists for a lightweight surfboard covering device that is capable of protecting all of the exposed surfaces of a surfboard with inflatable cushions or the like that may be defined by the cover itself. It would also be beneficial if such a covering device were designed to be readily deflated and configured in a small package for storage when not in use, and if the various inflatable cushions were capable of fluid communication between them. The present invention fulfils this need.

SUMMARY OF THE INVENTION

Briefly and in general terms, the present invention is directed to a protective surfboard covering device for covering and protecting the various surfaces of a surfboard during transport and storage. When not in use, the covering may be deflated and rolled or folded up for convenient storage until its next use.

The covering device can generally be described as a bag or covering sheath having a plurality of compartmentalized cushions constructed to complementally cover and receive the surfboard therebetween. The device is formed with a flexible outer layer and inner layer, and with partition walls that extend from the outer layer to the spaced apart inner layer, which collectively define the boundaries of the various cushions between them. In a preferred embodiment, predetermined segments of the outer layer, inner layer and partition walls respectively form an outward wall, an inward wall and side or upper and lower walls of a casing for each cushion. These walls are flexible and are interconnected in an air tight seal so that the inner surfaces of the casing walls form respective distensible cushion bladders therebetween. Thus, in one preferred embodiment, the casings walls cooperate to define both the outer contours and the internal volume of each respective cushion.

Air or any type of pressurized gas may be introduced into the bladders by valves to distend the casing walls and inflate the bladders, and the valves may deliver pressurized air directly to individual bladders or to multiple bladders through communication means formed through the partition walls. It is contemplated that the casing walls may be either inelastic, to permit inflation of the bladders from a deflated state to a predetermined volume, or elastic, to permit inflation of the bladders beyond such a predetermined volume if desired. When the user wishes to store the protective covering device, air may also be expelled through the valves to deflate the bladders. In an alternate embodiment, each of the casings defined by the inner and outer layers of the cover and the partition walls may encase a respective complementally shaped and inflatable cushion. The cushions in such an embodiment may be inflated and deflated on demand, and may be inserted into and removed from various respective casings through insertion openings formed in the outer layer of the cover.

Thus, the cover device will be formed with a plurality of compartmentalized cushions that may be configured to collectively correspond in general shape to that of a typical surfboard and to cover and protect the various desired exposed surfaces of the board. A typical surfboard will include a top board surface, a bottom board surface, a longitudinally spaced apart nose section and rear section and two laterally spaced apart side surfaces, also known as "side rails." Accordingly, in one preferred embodiment, the compartments will be configured to form a top cushion, a bottom cushion, and two side rail cushions for respectively covering and protecting the top surface, bottom surface, nose section and side rails of the surfboard. The side rail cushions may be connected in fluid communication at their forward extremities to cover and protect the nose section of the board, and may curve outwardly and rearwardly therefrom to track the contours of the side rails and terminate in respective laterally spaced apart rear extremities. The top and bottom cushions are situated between the side rail cushions and configured generally in the shape of a conventional ironing board to cover and protect the remaining portions of the top and bottom surfaces of the board.

So configured, the top, bottom and side rail cushions will form therebetween a surfboard compartment for receiving the surfboard therein when typically inserted with its nose section leading. The rear extremities of the top and bottom cushions and the side rail cushions further cooperate in forming a mouth that defines an opening for receiving the surfboard therethrough such that further advancement of the board will position it in the surfboard compartment. Closure means formed on the mouth facilitate the closing of the cover around the rear section of the board, and the mouth may be formed with an inflatable rear board cushion for protecting this rear section.

These and other features and advantages of the protective surfboard covering device will become apparent from the following detailed description of preferred embodiments which, taken in conjunction with the accompanying drawings, illustrate by way of example the principles of the invention.

BRIEF DESCRIPTION OF THE DRAWINGS

FIG. 4 is a transverse sectional view, in enlarged scale, taken along line 4—4 of FIG. 1;

FIG. 5 is a transverse sectional view, in enlarged scale, taken along line 5—5 of FIG. 1;

FIG. 6 is an enlarged detail view taken from circle 6 of FIG. 4;

FIG. 7 is a vertical sectional view, in enlarged scale, taken along line 7—7 of FIG. 2;

FIG. 8 is a vertical sectional view, in enlarged scale, taken along line 8—8 of FIG. 1 and depicting an exemplary inflation valve in an undeployed position;

FIG. 9 is a vertical sectional view, similar to FIG. 8, showing the inflation valve in a deployed position; and FIG. 10 is a transverse sectional view, in enlarged scale, of an alternative embodiment of the protective surfboard covering device of the present invention.

DETAILED DESCRIPTION OF THE PREFERRED EMBODIMENTS

Figure 1:
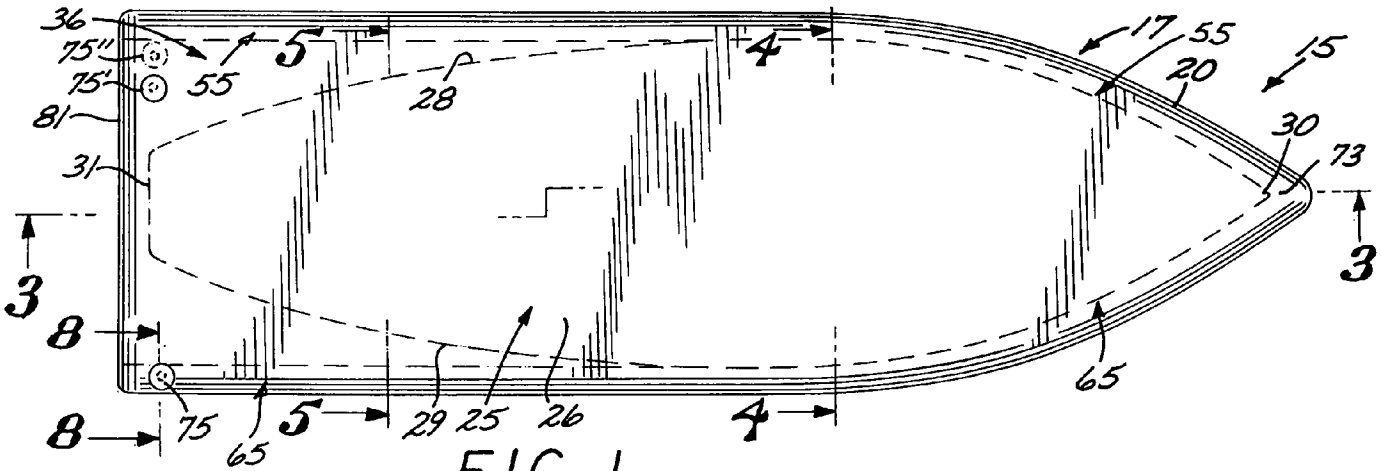
FIG. 1 is a top view of the protective surfboard covering device embodying the present invention.

Referring to FIGS. 1–4, the protective surfboard covering device 15 of the present invention includes, generally, a cover 17 having an inner layer 18, an outer layer 20 and various partition walls 22 that cooperate to define a plurality of compartmentalized inflatable cushions that, in one preferred embodiment, may include a top surface cushion 35, a bottom cushion 45 and a pair of laterally spaced apart sidewall cushions, 55 and 65. The cushions define therebetween an envelope forming a surfboard compartment 80 for receipt of a surfboard 25 therein, and their rear extremities cooperate to form a mouth 81 through which the surfboard is inserted into the surfboard compartment 80.

Figure 3:
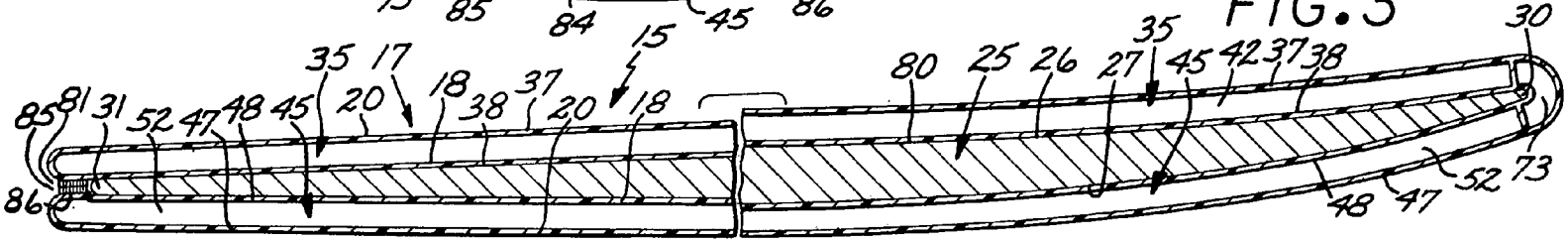
FIG. 3 is a broken longitudinal sectional view, in enlarged scale, taken along line 3—3 of FIG. 1.

The cushions 35, 45, 55 and 65 are collectively configured to cover the various surfaces of a typical surfboard 25, and it is contemplated that they may be sized and contoured to correspond in shape to any specifically manufactured board or for covering a wide variety of typically dimensioned boards. As shown in FIGS. 1 and 3, a typical surfboard 25 will include a dorsal or top surface 26, on which the surfer stands, a ventral or bottom surface 27, which is in contact with the water, a nose section 30 at the forward extremity of the board, a rear section 31 at the rear extremity of the board, a port side rail 28, which is defined by the left edge of the board when the surfer is facing the nose section 30 and a starboard side rail 29, which is similarly defined by the right edge of the board.

In one preferred embodiment as shown in FIG. 4, the cover 17 incorporates a dual-layered construction with an outer layer 20, whose outer surface is exposed to the external environment, and an inner layer 18, whose outer surface is in contact with the various surfaces of the board 25. The layers, 18 and 20, of the cover 17 may be formed of any suitable desired material, and are preferably formed from a non-permeable, flexible and durable yet lightweight material that will withstand exposure to the elements such as water and sunlight while also being resistant to tearing or other damage that may occur upon contact during transport and storage. In one preferred embodiment, the covering device is so constructed and sized as to when inflated closely fit the contours of at least a portion of the board and yet be receivable in a conventional surfboard travel bag (not shown). For example, it is contemplated that this material may take the form of a skin constructed of a plastic, vinyl, nylon, gortex, canvas or other such suitable materials that are well known in the art. It is also contemplated that the layers, 18 and 20, may further include an inner lining to lend additional water resistance to the cover 17. The exterior surface of the covering device may be treated to allow it to slide more easily into a surfboard travel bag. In that regard, the exterior surface may be frocked to give a smooth finish. Additionally, in some embodiments the covering device will be constructed as a stand-alone cover. In that event, it will be appreciated that to facilitate carrying with a surfboard received therein, a shoulder strap, handle or other similar carrying means (not shown) may be attached to the cover 17.

As shown in FIGS. 4 and 6, a plurality of partition walls 22 extend from the outer layer 20 to the inner layer 18 to compartmentalize the cover 17 into the various desired cushions. These partition walls 22 are flexible and define the lateral boundaries and transitions between adjacent cushions. With reference to FIG. 6, it is also contemplated that, where the partition walls 22 intersect with the outer layer 20, a transition groove 23 may be formed in the outer layer to demarcate the boundaries between the compartmentalized cushions. It is further contemplated that that the partition walls 22 may be defined by two vertically oriented wall segments permanently bonded or heat sealed to one another at a transition seam 24 such that these segments will define respective side, top or bottom walls of the adjacent cushion casings located on either side of the partition wall 22.

Thus, as shown in FIG. 4, to form the cushions, 35, 45, 55 and 65, respective selected sections of the outer layer 20, the inner layer 18 and the partition walls 22 cooperate to collectively define the walls of respective cushion casings, 36, 46, 56 and 66, and the inner surfaces of the walls of such casings define therebetween respective inflatable bladders, 42, 52, 62 and 72. The cushions may be inflated to configure the cover 17 for protective covering of the board 25 by introducing air or any desired pressurized gas into these bladders, and may be deflated by expelling air from the bladders when the surfer wishes to fold or roll up the cover 17 for storage when not in use. In this regard, the outer surfaces of the walls of the cushion casings, 36, 46, 56 and 66, define the outer contours of each respective cushion, 35, 45, 55 and 65, and the inner surfaces of these walls define the internal volume of each cushion. Additionally, while the invention is described herein as including top and bottom surface cushions, 35 and 45, and side rail cushions, 55 and 65, it is also in keeping with the invention to include any combination of these cushions. For example, such an alternative embodiment is depicted in FIG. 10, wherein the covering device 15 is shown as including only the side rail cushions, 55 and 65. In such alternative embodiments, it is also contemplated that the cover 17 may define covering sheets (not shown) for covering the surfaces that are not protected by such cushions, and that the covering sheets will cooperate with the cushions to form the surfboard compartment 80 therebetween. It is further contemplated that such covering sheets may incorporate padding or a similar shock absorbing material to protect all or a portion of the surfaces that are not protected by such cushions.

Turning now to the construction of the individual cushions, as shown in FIGS. 1 and 4, the outer layer 20, inner layer 18 and partition walls 22 of the cover 17 cooperate to form respective casings, 56 and 66, for a port side rail cushion 55 and a starboard side rail cushion 65, which respectively protect the port and starboard side rails, 28 and 29, of the surfboard 25. With continued reference to FIG. 4, the port side rail cushion 55 is formed with a outward wall 57 whose outer surface is exposed to the external environment, an inward wall 58 whose outer surface is in contact with the port side rail 28 of the board 25, and an upper and lower wall, 59 and 60, which respectively define the transition between the port side rail cushion 55 and the top and bottom cushions, 35 and 45. These walls, 57, 58, 59 and 60, cooperate to define the port side rail cushion casing 56. Similarly, the starboard side rail cushion 65 is formed with and outward wall 67, an inward wall 68, and an upper and lower wall, 69 and 70, which cooperate to define the starboard side rail cushion casing 66.

To provide protective capacity to the port and starboard side rail cushions, 55 and 65 respectively, the inner surfaces of the walls of the casings, 56 and 66, are gas impervious and configured to respectively define therebetween distensible and inflatable bladders, 62 and 72. While the cushions may take on any suitable shape and configuration for protecting the surfaces of the board 25, in one preferred embodiment as shown in FIG. 4, when the port side rail cushion bladder 62 is inflated, the port side rail cushion 55 will assume a "C"-shaped in vertical cross-section configuration to complement the shape of the port side rail 28 of the surfboard 25. So configured, at least the inward wall 58 will assume a concave in vertical cross-section curvature to complement the generally convex curving contour of the port side rail 28, and both the inward wall 58 and the outward wall 57 will project laterally inwardly over the lateral marginal edges of the port side top surface 26 and bottom surface 27 of the surfboard 25. Similarly, to complement the shape of the starboard side rail 29, the starboard side rail cushion 65 will assume an oppositely disposed and converse "C"-shape in vertical cross-section configuration upon inflation of the starboard side rail cushion bladder 76. So configured, the inward wall 68 of the starboard side rail cushion 65 will assume a concave curvature to complement the generally convex curvature of the starboard side rail 29, and both the inward wall 68 and the outward wall 67 will project laterally inwardly over the lateral marginal edges of the starboard side of the top and bottom surfaces, 26 and 27, of the surfboard 25. The "C"-shape of the preferred port and starboard side rail cushions is advantageous in that it permits the cushions to completely cover and protect the side rails, 28 and 29, by remaining in contact with the side rails throughout the entirety of their convex curvature while also projecting along a portion of the top and bottom cushions, 35 and 45, to provide protection at the vulnerable area of the transition between the top and bottom cushions and the side rails.

As is further shown in the preferred embodiment of FIGS. 1–4, the port side rail cushion 55 and the starboard side rail cushion 65 may be connected at their forward extremities to form what may be described as a cushioning nose cap 73 to cover and protect the forward most portion of the nose section 30 of the surfboard 25, and that the forward extremities of the top and bottom surface cushions, 35 and 45, may cooperate with the forward extremities of the side rail cushions, 55 and 65, in forming this cushioning cap 73. It is contemplated that the port and starboard side rail cushions may also be connected in fluid communication with one another, such that inflation of the port side rail bladder 62 will simultaneously result in the inflation of the starboard side rail bladder 72 and vice versa.

From their connection at their forward extremities in the vicinity of nose section 30, and when inflated, the port side rail cushion 55 and starboard side rail cushion 65 will angle rearwardly and outwardly to engage and extend generally coextensively along at least a portion of the length of the surfboard side rails, 28 and 29. As shown in FIGS. 1 and 5, at about the mid-point of the side rails, 28 and 29, of a typical surfboard 25, the side rails will transition from extending rearwardly and outwardly and will begin to extend rearwardly and inwardly towards the rear section 31 of the board. However, in the preferred embodiment depicted in FIGS. 1 and 5, at a point along the side rails, which may be generally located near the mid-section of the board 25, the port and starboard side rail cushions, 55 and 65, may then cease following the contours of the surfboard side rails and may begin to extend rearwardly in a generally parallel manner to terminate in respective laterally spaced apart rear extremities. However, it is also contemplated that, in an alternative embodiment, these side rail cushions, 55 and 65, may continue to trace the contours of the side rails, 28 and 29, and will extend rearwardly and inwardly therealong from the mid-section of the board 25 to terminate in their respective rear extremities, rather than extending in a parallel manner therefrom. In such an embodiment, at least a portion of the inner layer 18 of the cover in the vicinity of the side rail cushions, 55 and 65, is capable of flexing and expanding outwardly to accommodate the width of the mid-section of the board.

As shown in the preferred embodiment depicted in FIGS. 1–4, the cover 17 may also include a top surface cushion 35 and a bottom surface cushion 45 for respectively covering and protecting the top and bottom surfaces, 26 and 27, of the surfboard 25. The top surface cushion 35 is formed with an outward wall 37 whose outer surface is exposed to the external environment, an inward wall 38 whose outer surface is in contact with the top surface 26 of the board 25, and a port and starboard side wall, 39 and 40, which respectively define the transition between the top surface cushion 35 and the port and starboard side rail cushions, 55 and 65. These walls, 37, 38, 39 and 40, cooperate to define the top surface cushion casing 36. Similarly, the bottom surface cushion 45 is formed with and outward wall 47, an inward wall 48, and a port and starboard side wall, 49 and 50, which cooperate to define the bottom surface cushion casing 46.

To provide protective capacity to the top and bottom cushions, 35 and 45 respectively, the inner surfaces of the walls of their casings, 36 and 46, are gas impervious and configured to respectively define therebetween distensible and inflatable bladders, 42 and 52. While the cushions may take on any suitable shape and configuration for protecting the surfaces of the board 25, in one preferred embodiment as shown in FIGS. 1 and 3, the top and bottom cushions, 35 and 45, are disposed between the port and starboard side rail cushions, 55 and 65. With the port and starboard side rail cushions, 55 and 65, respectively covering and protecting the convex curving port and starboard side rails, 28 and 29, and projecting laterally inwardly over the lateral marginal edges of the top and bottom surfaces, 26 and 27, of the surfboard 25, the top and bottom cushions, 35 and 45, will respectively protect and cover the remaining portions of the top and bottom surfaces of the board. To do so, as shown in the preferred embodiment depicted in FIG. 1, the lateral edges of the top and bottom surface cushions, 35 and 45, may extend rearwardly and outwardly from the portions of the nose section 30 uncovered by the side rail cushions, 55 and 65, and then will continue to extend rearwardly and in a coextensive fashion along with the generally parallel and radially inwardly facing edges of the side rail cushions. In this configuration, the lateral edges of the top and bottom surface cushions, 35 and 45, will generally assume the shape of a conventional ironing board, extending rearwardly to terminate in respective rear extremities.

It will be appreciated that some surfboard designs also include either a single fin or multiple spaced apart fins, also known as "skegs" in surfing parlance, which generally extend downwardly from the bottom surface 27 of the surfboard 25 to provide control surfaces for enhancing the stability and maneuverability of the board in the water. Therefore, while not specifically depicted in FIGS. 1–10, it is also in keeping with the spirit of the invention to configure the bottom surface cushion 45 with either a single skeg pocket (not shown) or multiple skeg pockets for receipt of the skegs therein when the surfboard 25 is received in compartment 80. The skeg pockets may take any suitable form for protecting the skegs, and will initiate at a skeg opening formed in the inward wall 48 of the bottom cushion 45 and extend downwardly therefrom to terminate at a point short of the outward wall 57. In such an embodiment, it will be appreciated that the bottom surface cushion bladder 52 will be formed around the skeg pockets. It will also be appreciated that the bottom surface cushion may be configured with a depth relatively greater than the depth of the remaining cushions or the bottom cushion depicted in FIG. 3 to accommodate the length of the skegs as they extend downwardly from the bottom surface 27 of the board 25. Since such skegs are generally situated to extend from bottom surface near the rear or aft section of the surfboard, the skeg pockets will be positioned in corresponding locations near the rear extremity of the bottom cushion 55. However, it is within the scope of the invention to position these skeg pockets at any location to correspond to the location of the skegs, or to construct the skeg pockets as longitudinally elongated and parallel slits extending from the rear section of the bottom surface cushion 55 to a point in the vicinity of the mid-section of the cushion to accommodate variously located and dimensioned skegs that may be formed on a wide range of surfboards.

To inflate the respective bladders, 42, 52, 62 and 72, of the cushions 35, 45, 55 and 65, the cover 17 may be formed with a plurality of valves 75 to communicate air or any pressurized gas from a selected point on the outer layer 20 to a chosen bladder. The particular form of these valves is not essential to the invention, it only being important that the valve facilitate the inflation and deflation of the bladders. However, in a preferred and exemplary embodiment as depicted in FIGS. 8 and 9, the valve 75 is shown to include a distensible and retractable valve stem 76, an external flap 77 connected to the outer surface of the outer layer 20 of the cover for covering the valve stem to cut off the flow of air or expose the valve stem to permit the flow of air therethrough, and an internal flap 78 connected to the inner surface of the outer layer 20 for working in conjunction with the external flap to permit or cut off the flow of air to the selected bladder 72. As shown in FIG. 8, with the external flap 77 covering the valve stem 76 and holding it in a retracted position, and the internal flap in a closed position, air inside the bladder 72 will be prevented from flowing out of the valve 75. The external flap may be held in its closed position and releasable therefrom by way of a flap connector 79 formed between the distal extent of the external flap 77 and a corresponding portion of the outer layer 20. This valve flap connector 79 may take the form of any of the well known connecting devices known in the art, such as a hook and pile velcro construction, snap construction or the like. As shown in FIG. 9, with the external flap 77 in an opened position, the valve stem 76 will distend from its retracted position and pressurized air will be permitted to flow through the valve stem when introduced, which in turn will force the internal flap 78 into an open position to communicate the air to the selected bladder 72. It will also be appreciated that, in the open configuration of FIG. 9, the surfer may manipulate the valve to permit air to flow out of the bladder and through the valve 75 to deflate the bladder when the covering device 15 is not being utilized. Pressurized air may be provided and communicated through the valve 75 by any of a variety of portable air pumps that are known in the art, or may be expired from the lungs of the surfer to be directed through the valve as desired.

It is contemplated that a plurality of valves 75 may be configured in the cover 17 for inflating or deflating the bladders of individual cushions or multiple cushions that are in communication with one another, or that a single valve 75 may be utilized to communicate air to and from all of the cushion bladders. For example, four valves may be configured in the cover 17 for respectively inflating and deflating the top, bottom and side rail cushions, 35, 45, 55 and 65, individually. However, as shown in a preferred embodiment depicted in FIGS. 1 and 2, the cover 17 may be formed with three valves, with valve 75 being designated for inflating and deflating the starboard side rail cushion 65, which is in communication with the port side rail cushion 55, and valves 75' and 75" being respectively designated for inflating and deflating the top and bottom surface cushions, 35 and 45. However, any combination of valves may be chosen to inflate multiple cushions, or one valve may be chosen to inflate all of the cushions. In such embodiments, where a single valve 75 inflates and deflates multiple cushions, air will be communicated to the multiple cushions by passage means formed through the partition walls 22, with the passage means taking on any appropriate form, such as, for example, a reinforced conduit extending through the partition walls 22, for communicating air from a given bladder to adjacent bladders. Additionally, while in a preferred embodiment depicted in FIG. 1 the valves are situated near the rear extremity of the cushions, it will be appreciated that the respective valves may be located at any point on the cover 17 that will permit inflation and deflation of a corresponding cushion bladder therefrom.

By introducing air into the distensible bladders, 42, 52, 62 and 72, the bladders will be inflated to thereby distend the walls of the cushion casings, 36, 46, 56 and 66, and the cushions, 35, 45, 55 and 65 will be inflated to a desired volume for effectively protecting the surfaces of the board 25. Thus, for example, when air is introduced into the bladder 42 of the top cushion 35 through valve 75' (see FIGS. 1–3), the outward wall 37 will be distended away from the inward wall 38, and, as shown in FIG. 4, the outer surface of the inward wall 38 will be securely abutted against the top surface 26 of a surfboard 25 when it is received in the compartment 80. It will be also be appreciated that, when the selected bladder of a desired cushion is filled with pressurized air, the casing and its walls may be essentially inelastic to prevent the further distension of the casing walls past a predetermined volume or may be elastic to permit distension of the casing walls to a desired volume.

Additionally, while not depicted in FIGS. 1–10, it is contemplated that, in an alternate embodiment, any combination of the cushion casings, 36, 46, 56 and 66, may be configured for receiving and encasing therein a complementally contoured and separate cushion (not shown), which may be inflatable on demand and inserted into the casing. It will be appreciated that such separate cushions may also be formed from any suitable shock absorbing material such foam or other padding materials that are known in the art. In such and embodiment, the outer layer 20 of the cover 17, and accordingly the outward walls, 37, 47, 57 and 67 of respective casings, 36, 46, 56 and 66, may be formed with a cushion insertion slit (not shown) for inserting the separate cushion therethrough to be received in the casing. To close the insertion slit and secure the cushion in the casing after its insertion, the slit may be formed with a hook and pile velcro closure device, or any other suitable means that are well known in the art for closing off the slit such as a zipper, drawstring or snap construction.

Turning now to the manner in which the surfboard 25 is received in the covering device 15, the top surface cushion 35, the bottom surface cushion 45, the port side rail cushion 55 and the starboard side rail cushion 65 cooperate to define therebetween a surfboard compartment 80 for receiving the surfboard 25 therein. When the surfboard 25 is received in this compartment 80, the compartment is configured such that the forward extremities of the cushions completely encase the nose section 30 of the board and the cushions extend rearwardly to cover and protect the board's top and bottom surfaces, 26 and 27, and port and starboard side rails, 28 and 29, with the outer surfaces of the inward walls, 38, 48, 58 and 68, engaging these surfaces of the board.

Figure 2:
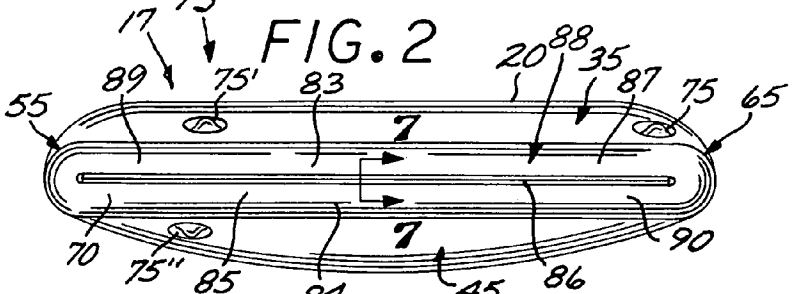
FIG. 2 is a left hand end view, in enlarged scale, of the covering device of FIG. 1.

As shown in a preferred embodiment depicted in FIG. 2, to receive the surfboard 25 into the compartment 80, the compartment is configured such that the cushions 35, 45, 55 and 65, terminate in respective cushion rear extremities that define therebetween a compartment access mouth 81 through which the surfboard is inserted into the compartment 80. As shown in FIG. 2, the mouth 81 may be formed by respective laterally projecting upper and lower lips, 83 and 84, joined at their lateral sides and defining therebetween a mouth opening 85 for passing the surfboard therethrough. The cushions are configured such that their rear extremities terminate at a point that is longitudinally spaced apart from the outer-most extremity of the rear section 31 of the board 25 such that the rear extremities of the cushions, and the mouth 81 they define, extend slightly beyond the board's rear section 31 when the board 25 is received in compartment 80.

Closure means 86 formed on the upper and lower lips, 83 and 84, facilitate the closure of the mouth around the board's rear section 31. While the preferred embodiment depicted in FIGS. 7 and 3 show this closure means 86 as having a hook and pile Velcro® type construction, the particular form of the closure means is not essential to the invention and may take the form of various closure means that are well known in the art, such as an inherent bias of the inflated lips, a zipper, a drawstring, a strap and buckle or snap construction, or any other form of suitable fastener for closing the mouth opening 85. Also, as depicted in the preferred embodiment of FIG. 2, the lips, 83 and 84, may be formed with respective upper and lower lip cushion segments, 89 and 90, which may also collectively define a rear cushion 88 for covering and protecting the rear section 30 of the board 25 when it is received in the compartment 80 and the closure means 86 is closed. The lip cushion segments, 89 and 90, and/or the rear cushion 88 may be inflatable and deflatable as, for example, by the addition of a valve 75 as described above, or, as in a preferred embodiment depicted in FIG. 2, may be formed from a self supporting shock absorbing material such as foam or another suitable padding material. In such an embodiment, when the cushions 35, 45, 55 and 65 are in a deflated state, the self supporting rear cushion 88 will provide an internal support member around which the cover 17 may be rolled or folded for convenient storage of the covering device 15 when it is not being utilized by the surfer to cover and protect his or her board.

In operation, when a surfer desires to protectively cover his or her surfboard 25 for transport or storage, he or she will lay out the cover device 15, in its deflated state, and may then proceed to inflate the cushions. It will be appreciated that the surfer may inflate the cushions and then insert the board into compartment 80, or may first insert the board into the compartment and then inflate the cushions. In selecting the preferred embodiment depicted in FIGS. 1 and 2, to inflate the cushions, the surfer may, for example, first introduce pressurized air into the starboard side rail cushion bladder 72 through valve 75. To configure the valve 75 for introducing pressurized air into bladder 72, the surfer will first move the external flap 77 from its closed position as shown in FIG. 8 to its open position in FIG. 9, which will cause the valve stem 76 to distend from its retracted position shown in FIG. 8 to its deployed position in FIG. 9. The surfer will then connect a portable air pump to the valve 75 and begin to introduce pressurized air from the pump into the valve. The surfer may also expire air from his or her lungs into the valve if a pump is not available. When pressurized air begins to flow through the valve 75, it will force the internal flap 78 to shift from its closed position as shown in FIG. 8 to its open position in FIG. 9, which in turn will communicate air through the valve 75 to the side rail cushion bladder 72.

The introduction of this pressurized air will begin to increase the volume of air in bladder 72, which will cause the starboard side rail cushion casing 66 to expand as the outward wall 67 distends away from the inward wall 68. Similarly, with the starboard side rail cushion bladder 72 being configured in communication with the port side rail cushion bladder 62, pressurized air will be simultaneously introduced into the port side rail cushion bladder 62 to increase its volume and cause the port side rail cushion casing 56 to expand as the outward wall 57 distends away from the inward wall 58. The inflation of the bladders 72 and 62 and the expansion of the casings 66 and 56 will continue until the casings are distended to a specific predetermined volume, or until the casings are distended to a volume desired by the surfer. Thus, the starboard side rail cushion 65 and the port side rail cushion 55 will be, in their inflated state, configured in a "C"-shape and prepared to, when the board 25 is later inserted into compartment 80, complementally cover and protect the respective convex curving side rails 29 and 28 the surfboard 25 while also projecting laterally and inwardly over the lateral marginal edges of the top and bottom surfaces, 26 and 27, of the board.

The surfer will then undertake a similar sequence for inflating the top surface cushion 35 and the bottom surface cushion 45. To do so, the surfer may next deploy valve 75' and introduce pressurized air into the top surface cushion bladder 36 as described above, which will cause the top surface cushion casing 36 to expand as the outward wall 37 distends away from the inward wall 38. When a desired or predetermined volume in the bladder 36 and expansion of the casing 36 is attained, the user may then follow a similar sequence to inflate the bottom surface cushion 45 through valve 75".

With the top, bottom and side rail cushions, 35, 45, 55 and 65 respectively, inflated, surfboard compartment 80 will be formed therebetween and the rear extremities of the cushions will cooperate to form the mouth 81. The surfer will then ensure that the closure means 86 is in its opened position and may then insert his or her surfboard 25 through mouth 81 and advance it forwardly into compartment 80 until the nose section 30 of the board is securely encased by the forward extremities of the cushions. As shown in FIG. 1, when fully inserted in the compartment 80, the surfboard 25 will be covered and protected in the covering device 15 with the top surface cushion 35 engaging the top surface 26, the bottom surface cushion 45 engaging the bottom surface 27, and the port and starboard side rail cushions, 55 and 65 respectively engaging the port and starboard side rails, 28 and 29. If the surfboard 25 is constructed with skegs, the surfer will also ensure that the skegs are positioned within the skeg pockets so that they may be protected during transport and storage. In boards having removable skegs, the surfer may either leave them attached and position them in the skeg pockets, or may remove the skegs and insert them into the compartment 80 along with the surfboard 25.

So configured, the rear extremities of the cushions and the mouth 81 will extend slightly beyond the rear section 31 of the board 25 and the surfer may then position lips 83 and 84 over the rear section and close the closure means 86 as shown in FIGS. 2 and 7. This will in turn position the rear cushion 88 over the rear section 31 of the board to protect and cover it. The surfer may then transport or store the surfboard 25 in the protective covering device 15 as desired with the board securely received in compartment 80 and its surfaces being protected by the top, bottom, side rail and rear cushions, 35, 45, 55, 65 and 88 respectively. The covered surfboard may then be slid into a conventional surfboard bag and the access opening(s) thereof closed to hold the covering device and surfboard in place. When the surfer arrives at his or her destination, the travel cover may be removed and the board withdrawn from the protective covering device. The surfer may then deflate the cushions by manipulating the valve(s) 75 to release the pressurized air from the bladders. Once the cushions have been deflated, the surfer may then position to self-supporting rear cushion 88 as a support member and roll or fold the cover 17 over the rear cushion to configure the protective covering device 15 in a convenient and compact bundle for storage.

While several particular forms of the invention have been illustrated and described, it will also be apparent to those skilled in the art that various modifications can be made without departing from the spirit and scope of the invention. Accordingly, it is not intended that the invention be limited except by the following claims.

What is claimed is:

1. An inflatable surfboard cover device for covering a surfboard having top and bottom surfaces and including a forward section having side rails converging in a forward direction to a bow, the device comprising:

an elongated envelope including top and bottom cushions for covering the top and bottom surfaces of the surfboard;

the envelope further including inflatable tubular side rail cushions connected between the top and bottom cushions and cooperating therewith to form a surfboard compartment configured with a forward portion complementarily shaped to receive the forward section of the surfboard and permanently closed along the opposite sides;

the envelope formed at its rearward end with a mouth for insertion of the surfboard therethrough into the compartment;

the side rail cushions being formed from flexible gas impervious walls configured to be, when inflated and the surfboard is received in its compartment, distended to inflated configurations having respective C-shaped lateral cross sections in at least the forward portion to complementarily embrace the outboard edges of the side rails of the surfboard;

the top and bottom cushions and side rail cushions cooperating to, when the side rail cushions are inflated, constrain the side rail cushions laterally inwardly against the side rails in the forward portion to maintain the envelope in position on the surfboard with the side rail cushions cushioning at least the forward section of the side rails against damage from impacting forces; and a valve for admitting pressurizing gas to the side rail cushions.

2. The surfboard cover device of claim 1 that includes:

an inflatable tubular lip at the rear extremity of the top, bottom and side rail cushions and configured to circumscribe the mouth; and a closure device for releasably fastening the mouth closed.

3. The surfboard cover device of claim 1 for use with a surfboard configured with the opposite side rails converging rearwardly and inwardly toward the rear of the surfboard from an intermediate location on the surfboard and wherein:

the side rail cushions are configured to project rearwardly from the forward portion substantially parallel to one another.

4. An inflatable surfboard cover device for covering a surfboard configured with a forward section having forwardly converging opposite side rails and top and bottom surfaces and comprising:

an elongated flexible inflatable and deflatable envelope formed by longitudinally extending inflatable tubular side rail cushions configured in transverse cross section with an inwardly facing C-shape to embrace, at least, the side rails in the forward section and terminating along their respective lengths, at the respective terminus of the C-shape, in laterally inwardly facing, upper and lower longitudinal partition walls;

the envelope further including elongated upper and lower longitudinal inflatable cushions defining respective upper and lower cushioning chambers and configured to cover the top and bottom surfaces of the surfboard and formed along the length at their respective laterally outer extremities with respective longitudinal partition walls abutting the respective upper and lower rail longitudinal partition cushion walls and being heat welded thereto;

the envelope further including an inflatable nose cushion affixed to the forward extremity of the respective rail cushions, and the top and bottom cushions;

the envelope cooperating to form a compartment for complementarily receiving the surfboard and terminating at its rearward extremity in a mouth openable for access to the compartment;

a releasable fastener for fastening the mouth closed; and pneumatic valves for introducing compressible gas to the respective rail, top and bottom and nose cushions for inflating of the cushions to cooperate in holding the rail cushions embraced laterally inwardly against the rails at the forward portion of the board to cooperate in providing pneumatic cushioning against impact of exterior forces against the surface of the surfboard.

5. An inflatable surfboard covering device for covering a surfboard having top and bottom surfaces and side rails converging in a forward section to a bow, the device comprising:

a flexible skin material constructed to form a plurality of discrete inflatable cushions defining pneumatic chambers and cooperating to define an envelope formed with an elongated surfboard compartment closed on its forward end and lateral sides and shaped, at least in its forward portion, to complementarily receive the forward section of the surfboard, the chambers constituted to receive pneumatic cushioning means to, when the surfboard is in the compartment, be disposed in close complementarily fitting relationship along the respective side rails, to cover the side rails edges to pneumatically cushion the side rails thereof;

top and bottom surface pneumatic cushioning means for extending between the respective side rails for cushioning the respective top and bottom surfaces of the surfboard;

releasable means openable to receive the surfboard into the compartment; and valve means for controlling flow of gas into the respective discrete cushions.

6. An inflatable surfboard cover device for covering a surfboard having top and bottom surfaces and forwardly converging side rails terminating in a bow and comprising:

an envelope configured to be complementarily received over the surfboard and formed along its lateral sides with respective single chamber inflatable side rail cushions to upon being inflated, distend the walls of the envelope a laterally inwardly opening C-shaped transverse cross sectional configuration to embrace the opposite edges of the respective side rails to cushion the side rails against contact from exterior forces, the envelope further including a cover for covering the top and bottom sides of the surfboard for cushioning thereof; and a valve for introducing compressible gas to the side rail cushions.

* * * * *

UNITED STATES PATENT AND TRADEMARK OFFICE

CERTIFICATE OF CORRECTION

PATENT NO. : 7,017,747 B2
APPLICATION NO. : 10/630246
DATED : March 28, 2006
INVENTOR(S) : Michael W. Kiger and Joseph Carcamo It is certified that error appears in the above-identified patent and that said Letters Patent is hereby corrected as shown below:

Title Page, Item (54)AND COLUMN 1 Line 1,
delete, "INFLATABLE"

Signed and Sealed this

Eighth Day of August, 2006

JON W. DUDAS
*Director of the United States Patent and Trademark Office*